US005488836A

United States Patent [19]

Laude-Bousquet

[11] Patent Number: 5,488,836

[45] Date of Patent: Feb. 6, 1996

[54] METHOD OF AND DEVICE FOR HEAT EXCHANGE WITH A FLUID IN THE COURSE OF PARTIAL FREEZING

[75] Inventor: Adrien Laude-Bousquet, Anse, France

[73] Assignee: Thermique Generale et Vinicole, Anse, France

[21] Appl. No.: 301,019

[22] Filed: Sep. 6, 1994

[30] Foreign Application Priority Data

Sep. 8, 1993 [FR] France ..... 93 10887

[51] Int. Cl.[6] ..... B01D 9/04

[52] U.S. Cl. ..... 62/532; 62/123; 165/92

[58] Field of Search ..... 62/532, 354, 123; 165/92

[56] References Cited

U.S. PATENT DOCUMENTS

| | | | |
|---|---|---|---|
| 2,749,722 | 6/1956 | Knowles . | |
| 3,438,742 | 4/1969 | Grunewald et al. | 165/92 |
| 3,473,603 | 10/1969 | Fujie | 165/92 |
| 3,477,499 | 11/1969 | Goetz | 165/92 |
| 4,660,628 | 4/1987 | Solberg et al. | 165/92 |
| 5,141,328 | 8/1992 | Dilley | 165/92 |
| 5,228,503 | 7/1993 | Smith | 62/354 |

FOREIGN PATENT DOCUMENTS

| | | |
|---|---|---|
| 0257936 | 3/1988 | European Pat. Off. . |
| 2706 | of 1880 | United Kingdom . |

*Primary Examiner*—Ronald C. Capossela
*Attorney, Agent, or Firm*—Oliff & Berridge

[57] ABSTRACT

The present invention relates to a device for heat exchange between a refrigerant in the course of vaporization and a fluid to be cooled in the course of freezing. According to the invention, the device comprises a conduit for the fluid to be cooled, a shell making, around the conduit, a chamber for the passage of the refrigerant, and a mechanical means for separating, from the wall of the conduit, any solid phase of the fluid to be cooled, consisting of a rotor provided with radial and flexible filaments. The invention applies in particular to the production of homogeneous mixtures of water and ice.

19 Claims, 8 Drawing Sheets

17
40
2
5
5
2
1
9
13
12
15
14
7
14
3
8
15
3
13
6
6b
6a
11
14
14
13
1
10
4
2

22
22
9
1
24
23
18
7
23
8
3
12
13
6
11
14
26
28
18
25
1
9
27
2
5
5
2
4
21
2

17
40
31
29
2
4
1
10
11
7
16
8
12
13
V
VI
3
6
9
5
30

14
8
7
12
3

METHOD OF AND DEVICE FOR HEAT EXCHANGE WITH A FLUID IN THE COURSE OF PARTIAL FREEZING

BACKGROUND OF THE INVENTION

The present invention relates in general to any indirect heat exchange between, on the one hand, a refrigerant or refrigerating fluid, for example a refrigerant (for example ammonia) in the course of vaporization, and, on the other hand, a fluid to be cooled, namely a liquid in the course of cooling and/or partial freezing, to the exclusion of any congealing of said fluid, such as of water containing glycol, alcohol or salt, the crystallization point of which is less than 0° C.

DESCRIPTION OF THE PRIOR ART

As regards cooling with partial freezing of a liquid or fluid, so as to prevent the latter from congealing under the effect of its solidification, and to obtain a fluid consisting of a homogeneous mixture of the liquid and solid phases of the fluid, so-called "scraped-surface" heat exchange devices are already known and used, these comprising:

- at least one conduit for pressurized circulation of the fluid to be cooled, from an inlet to an opposed outlet for said fluid, the wall of which constitutes a surface for heat exchange with a face, called the warm face, in contact with the fluid to be cooled, and an opposite face, called the cold face, in contact with the refrigerant;
- a shell making, with and around said circulation conduit, a chamber or means for receiving or passing the refrigerant, preferably with counterflow of the fluid to be cooled, from an inlet to an outlet for said refrigerant;
- and a mechanical means resisting the deposition, on the warm face of the wall of the conduit, of any solid layer of the fluid in the course of cooling, this means including a rotor mounted within said conduit, and various elements resisting said deposition, each consisting of a scraper in contact with or in the vicinity of the warm face of the wall of the conduit; these various elements called resisting elements are distributed along the axis of and around the rotor and are driven by a motory means mounted on the outside of the circulation conduit.

Such a scraped-surface heat exchange device makes it possible to exchange heat between, on the one hand, the refrigerant, for example in the course of vaporization, and, on the other hand, the fluid to be cooled, in the course of partial freezing, and this is so:

- by causing circulation of a stream of the fluid to be cooled, under pressure in the circulation conduit, in indirect heat exchange with the refrigerant, on either side of the heat exchange wall, that is to say of the wall of said conduit, one of the faces of which, called the warm face, is in contact with the fluid to be cooled and the other face of which, called the cold face, is in contact with the refrigerant,
- and by resisting, by means of the rotor with its scrapers, the deposition, on the warm face of the heat exchange wall, of any solid layer of the fluid to be cooled.

Nowadays, scraped-surface heat exchangers constitute devices which have a complicated structure and are complicated to construct, and therefore have a non-negligible cost, in particular if the scrapers are mounted on the rotor in a pivoting manner, each with its own return means.

The subject of the present invention is an alternative to scraped-surface heat exchangers, which is much simpler as regards its construction and its operation.

SUMMARY OF THE INVENTION

According to the present invention, in general, in order to resist the deposition of any solid layer on the warm face of the heat exchange wall, a turbulent boundary layer is created in the stream of the fluid to be cooled, circulating in the aforementioned pressurized circulation conduit and in contact with the warm face of the heat exchange wall, said turbulent boundary layer being undercooled in the liquid phase, and in direct heat exchange with the rest of the stream of the fluid to be cooled.

For this purpose, various elements resisting the deposition of any solid layer of the fluid to be cooled, on the warm face of the heat exchange wall, comprise a multiplicity of flexible filaments, one end of which is fastened to the rotor, and the other, free end of which is adjacent, that is to say in contact with or in the vicinity of, but some distance from, the warm face of the heat exchange wall. By being connected with the rotation of the rotor, the flexible filaments are essentially arranged in order to agitate, in liquid phase, the boundary layer of the stream of the fluid to be cooled, in contact with the warm face of the heat exchange wall, and in mixture with the rest of said fluid to be cooled.

By "undercooled" is meant the characteristic by which the heat exchange fluid is brought, in liquid phase, that is to say without at least partial freezing, to a temperature below its crystallization point.

By virtue of the present invention, the formation of a turbulent boundary layer in contact with the warm face of the heat exchange wall has the effect of bringing about freezing, not on the warm face of said wall, but within the circulating fluid to be cooled, immediately in the vicinity of said wall, by direct heat exchange, that is to say by the mixing of the turbulent undercooled boundary layer, expelled from said warm face, with the rest of the fluid to be cooled.

As indicated previously, this turbulent boundary layer is obtained, preferably, but not exclusively, by the vibratile effect of agitation and/or homogenization of the rotating free end of the flexible filaments.

The intrinsic characteristics of these filaments, including the nature (in terms of flexibility and/or rigidity, strength at low temperatures, etc.), as well as the arrangement of these various filaments, including the density per unit of surface area, are chosen, on the one hand, as a function of the nature of the fluid to be cooled and, on the other hand, as a function of the rotational speed of the rotor, so as to obtain the production of the turbulent boundary layer in the liquid phase, characterizing the present invention.

The present invention also provides the following key advantages.

By virtue of the direct heat exchange between the turbulent boundary layer and the rest of the fluid to be cooled, and/or under the action of the free end of the multiplicity of filaments, freezing of the fluid to be cooled takes place by obtaining microcrystals, that is to say crystals of solid phase of size much less than that of the crystals obtained with a scraped-surface exchanger. Production of such microcrystals promotes the homogeneity of the cooled fluid, that is to say of the mixing of the liquid and solid phases of said fluid. Furthermore, these microcrystals reduce or suppress the fusion inertia of the cooled fluid, obtained in two-phase form, this appearing to be extremely favorable when said fluid is used subsequently in heat exchange processes, especially refrigeration processes, with exchange of the latent heat of fusion of the solid phase of said fluid.

The present invention also makes it possible to reduce or limit the consumption of energy necessary, especially mechanical energy, for preventing or counteracting the formation of any solid layer on the warm face of the heat exchange wall.

Furthermore, the invention also makes it possible to increase the heat exchange coefficient of the fluid in the course of cooling, with respect to the heat exchange wall.

According to the present invention, in a preferred manner, but not exclusively, the following embodiments may be adopted:

said resisting elements are separated from each other, forming a plurality of filamentary members, these being especially arranged axially and distributed along the axis of and around the rotor; or said filaments together constitute a continuous or discontinuous helix about the axis of the rotor;

the means for driving the rotor consists of a motor mounted outside the circulation conduit and coupled to the rotor of the latter; alternatively, there is no external motor and the means for driving the rotor are constituted by any automotory system or arrangement, driving said rotor under the motory effect of the fluid to be cooled passing through the circulation conduit; this automotory system or arrangement may, moreover, be applied to any cooling device, such as generally defined in the preamble of the present description, whether or not in accordance with the present invention, the circulation conduits may be arranged in a battery, and, for this purpose, the device according to the invention comprises a plurality of conduits for circulation of the fluid to be cooled, these being arranged in parallel, and a common shell making, with said conduits, one and the same chamber for passage of the refrigerant, a distributor for distributing the fluid to be cooled into the various circulation conduits, and a manifold for the cooled fluid discharged from the various circulation conduits; in this case, a plurality of streams of the fluid to be cooled are caused to circulate, in indirect heat exchange with the refrigerant.

DESCRIPTION OF THE DRAWINGS

The present invention is now described with reference to the appended drawing, in which.

DESCRIPTION OF THE PREFERRED EMBODIMENTS

Figure 1:
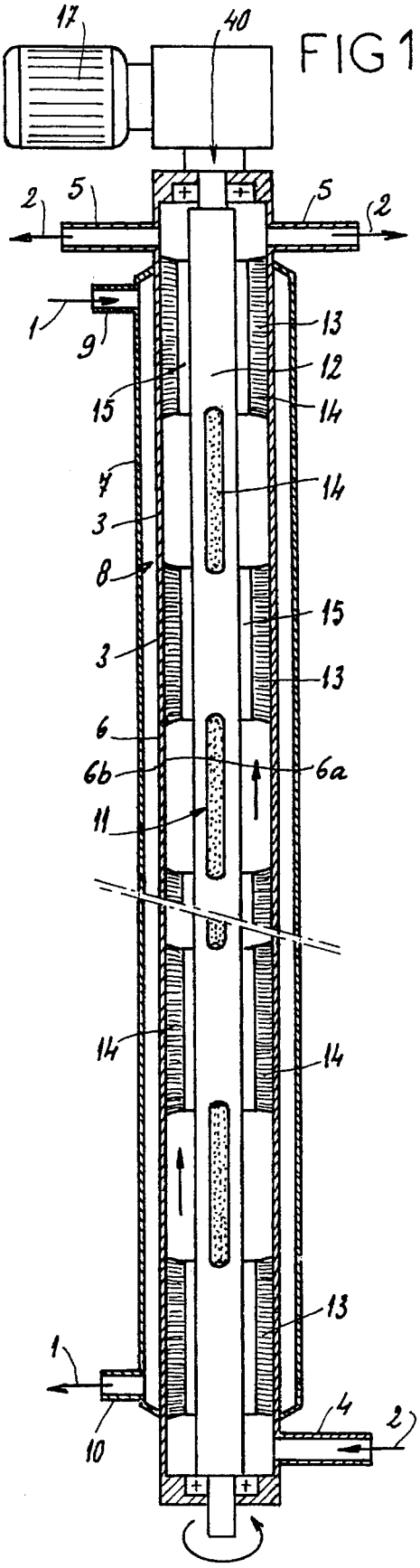
FIG. 1 depicts, in vertical section, a heat exchange device according to one embodiment of the invention.

In accordance with FIG. 1, the device according to the invention makes it possible to exchange heat indirectly between, on the one hand, a refrigerant 1, for example ammonia, in the course of vaporization, and, on the other hand, a fluid 2 to be cooled, for example water, the freezing point of which has been lowered (for example water containing glycol, alcohol or salt), in the course of partial crystallization or freezing. This device comprises:

a straight conduit 3, arranged vertically, for the pressurized circulation of the fluid 2 to be cooled, from an inlet 4 located at the bottom of the conduit 3 to two opposed outlets 5 located at the top of the conduit 3; it is the metallic wall 6 of the conduit 3 which constitutes the surface for heat exchange between the refrigerant 1, on its so-called cold-face *6b* side, and the fluid 2 to be cooled, on its so-called warm-face *6a* side;

a shell 7, added to the conduit 3, making, with and around the latter, a chamber or means for passing the refrigerant 1, with counterflow of the fluid 2 to be cooled, from a top inlet 9 to a bottom outlet 10;

a mechanical means 11 resisting the deposition, on the warm face *6a* of the heat exchange wall 6, of any solid layer of the fluid to be cooled.

In accordance with the invention, this mechanical means 11 comprises:

a rotor 12 mounted within the conduit 3;

a plurality of filamentary members 15 arranged axially, these being distributed along the axis of and around the rotor 12, and each including a multiplicity of radial and flexible filaments 14, forming elements 13 resisting the deposition of any solid layer on the warm face *6a* of the wall of the conduit 3; these filaments 14 may be produced, for example, in any synthetic material which is both relatively flexible and rigid, for example from polyamide yarns; each filament 14 has one end fastened to the rotor and the other, free end adjacent to the wall of the circulation conduit, that is to say in contact with or in the immediate vicinity of the warm face *6a* of the conduit 6;

and a means 40 for driving the rotor 12 equipped with filamentary members 15.

As depicted in FIG. 1, the filamentary members 15 are separated from each other, being both superimposed in groups of two and angularly offset with respect to the axis of the rotor, for example at an angle of 90° or 60°, from one group to the other, and this being so from one end of the circulation conduit 3 to the other. Furthermore, two filamentary members 15 of the same group are arranged in an opposite manner in one and the same diametral plane.

The means 40 for driving the rotor consists of a motor 17 mounted outside the circulation conduit 3 and coupled to the rotor 12 by any appropriate means, for example a gear motor.

With the exchanger previously described with reference to FIG. 1, heat is exchanged between, on the one hand, the refrigerant i in the course of vaporization, in the chamber made between the shell 7 and the conduit 3, and, on the other hand, the fluid to be cooled, circulating under pressure in the conduit 3, in the course of partial freezing, to the exclusion of any congealing of said fluid, especially by deposition of a solid layer on the warm face 6*a* of the metallic wall 6. For this purpose:

a stream of the fluid 2 to be cooled is caused to circulate, under pressure, in the conduit 3, in indirect heat exchange with the refrigerant 1, said fluids being respectively on either side of the heat exchange wall 6. The warm face 6*a* of the wall 6 is in contact with the fluid to be cooled, whereas the other, cold face 6*b* of the same wall 6 is in contact with the refrigerant 1;

by virtue of the mechanical means 11, constituted as described previously by the rotor 12 and its plurality of filamentary members 15, and of the drive means 40, a turbulent boundary layer is created in the stream of the fluid 2 to be cooled and in contact with the warm face 6*a* of the wall 6 of the conduit 3, said turbulent boundary layer being undercooled in the liquid phase and in direct heat exchange with the rest of the stream of the fluid to be cooled.

Thus, not only is the deposition, on the warm face 6*a* of the wall 6, of any solid layer of the fluid to be cooled, resisted, but also the direct and homogeneous mixing of said layer with the rest of the stream of the fluid to be cooled is promoted, by forming microcrystals of solid phase which are entrained and discharged into the stream, without the possibility of adhesion or deposition on the aforementioned warm face 6*a* of the wall 6.

Figure 2:
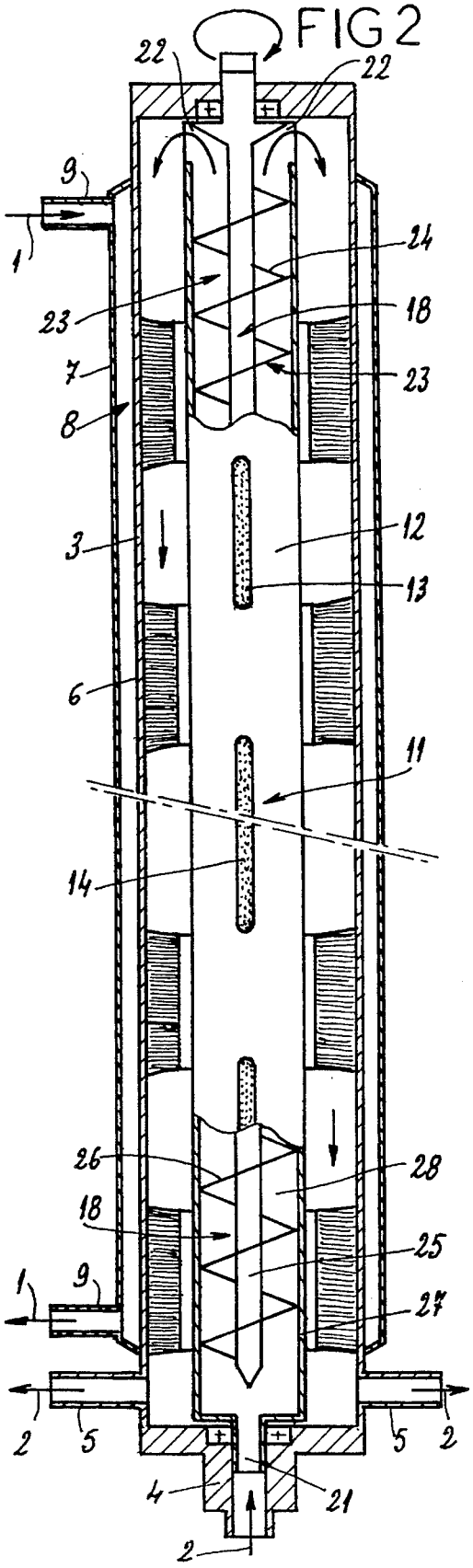
FIG. 2 depicts, still in vertical cross section, a heat exchange device according to a second embodiment of the invention.

The embodiment depicted in FIG. 2 differs from the one described previously by the manner in which the rotor 12 is driven.

According to FIG. 2, the rotor is driven with a means 18 acting under the motory effect of the fluid 2 to be cooled, passing through the circulation conduit 3.

In accordance with FIG. 2, this means 18 is obtained by the combination of the following arrangements:

the rotor 12 is hollow, and designed for axial circulation of the fluid 2 to be cooled, prior to its circulation in the conduit 3, from an axial inlet 21, on the side of the inlet 4 into the circulation conduit, to an opposed outlet 22 for introduction of the fluid, by returning into the actual conduit 3, between the latter and the rotor 12;

a means 23, which is motory under the effect of the fluid 2 circulating inside the rotor 12, is mounted in the latter and rotationally secured to the said rotor; according to this embodiment, this motory means 23 consists of a helix 24 coaxial with the rotor 12, including an axial core 25 and a helical blade 26 connecting the latter to the wall 27 of the rotor, making a helical channel 28 for circulation of the fluid 2 to be cooled.

Figure 3:
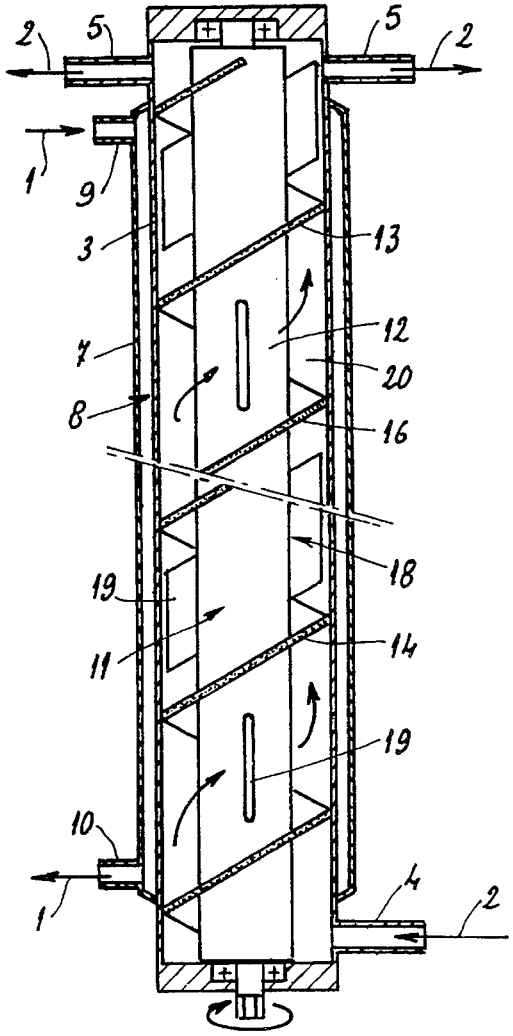
FIG. 3 depicts, in vertical longitudinal section, a heat exchange device according to a third embodiment of the invention.

The embodiment of FIG. 3 differs from those described with reference to FIGS. 1 and 2 by the following technical characteristics:

the resisting elements 13, or multiplicity of radial and flexible filaments 14, together constitute a continuous helix 16, around the axis 12, this additionally making it possible to transport the fluid 2 to be cooled, in the manner of an Archimedean screw;

the driving of the rotor 12, under the motory effect of the fluid 2 to be cooled passing through the circulation conduit 3, is obtained in another manner; more precisely, a plurality of blade elements 19 are mounted on the rotor 12, each extending along at least one radial direction and exhibiting, with respect to the circulating fluid 2, a front surface locally opposing resistance to said fluid; as shown in FIG. 3, the blade elements are distributed and arranged in the interstice 20 delimited by the radial helix 16.

Figure 5:
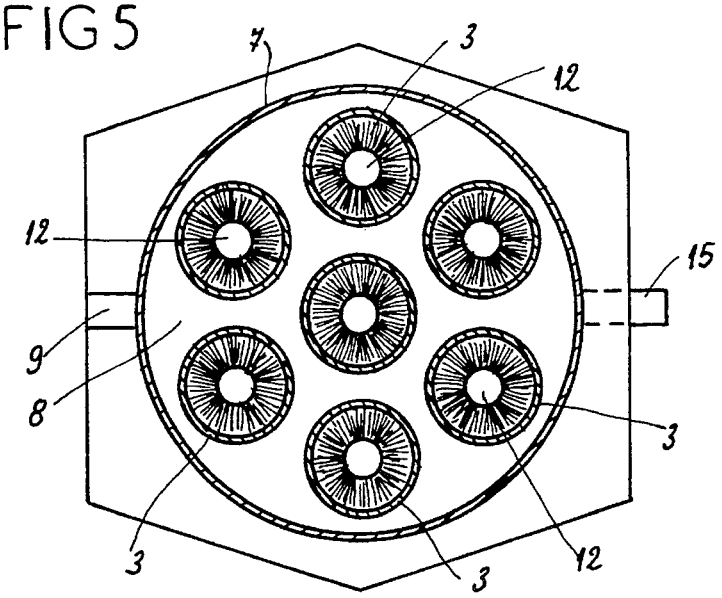
FIG. 5 depicts the device according to FIG. 4, in section along the line V—V of the latter.
Figure 4:
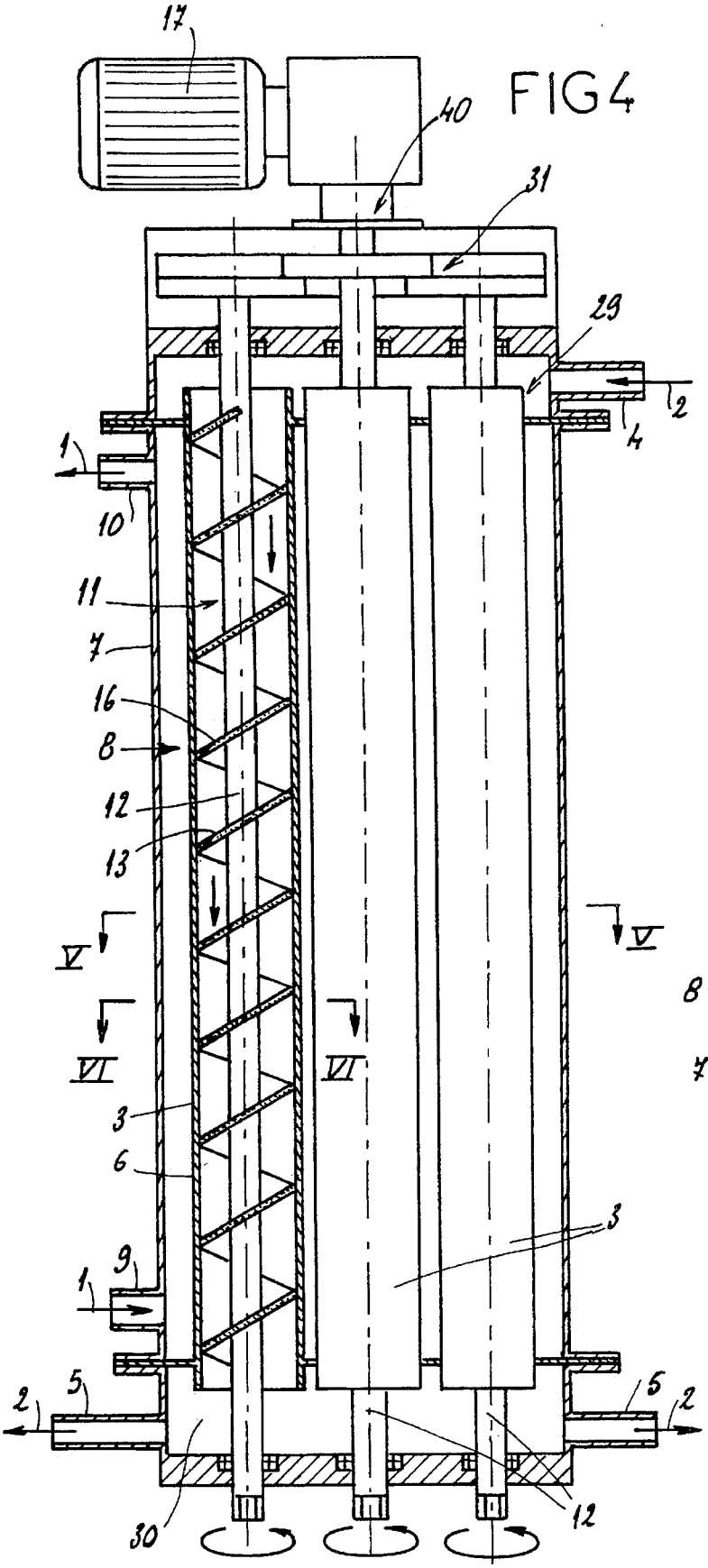
FIG. 4 depicts, in vertical section, a heat exchange device according to a fourth embodiment of the invention.
Figure 6:
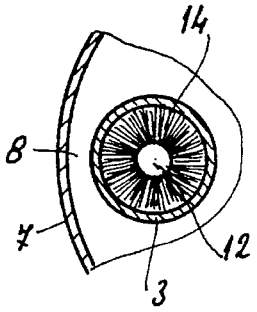
FIG. 6 depicts a sectional view of a circulation conduit forming part of the device according to FIGS. 4 and 5, along the cutting line VI—VI of FIG. 4.

The embodiment described with reference to FIGS. 4 to 6 differs from those described previously by the fact that the circulation conduits 3 for the fluid to be cooled are arranged in a battery. For this purpose, there is therefore a plurality of conduits 3, which are arranged in parallel, and one and the same common shell 7, for example a cylindrical shell, making, with the conduits 3, one and the same chamber 8 for passage of the refrigerant. From top to bottom of the device are respectively a distributor 29 for distributing the fluid 2 into the various conduits 3, and a manifold 30 for the cooled fluid 2 discharged from the various conduits 3, this distributor and this manifold being separate from and sealed with respect to the chamber 8 for passage of the refrigerant.

Moreover, one and the same motor 17 is coupled by a transmission means 31 to the various rotors 12 of the various circulation conduits 3.

Figure 7:
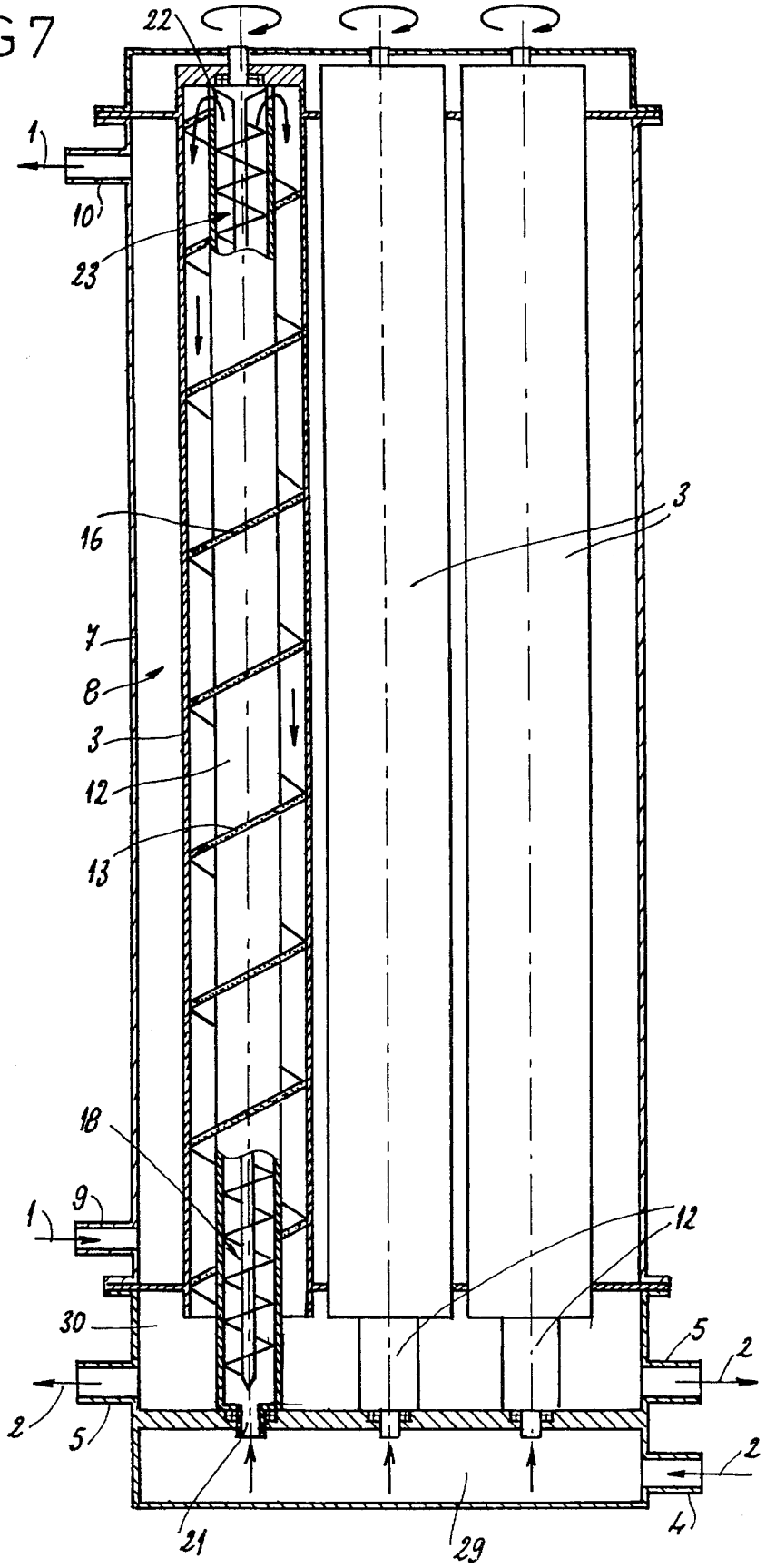
FIG. 7 depicts a heat exchange device according to a fifth embodiment of the invention.

The embodiment depicted in FIG. 7 includes a battery of conduits 3, as described previously with reference to FIGS. 4 to 6. But in this case, and as already described with reference to FIG. 2, the motor 17 has been omitted in favour of the motory means 23 incorporated into the rotors 12, and only acting under the effect of the circulation of the fluid 2. For this purpose, the distributor 29 for the fluid to be cooled communicates solely with the various axial inlets 21 of the hollow rotors 12 of the various circulation conduits 3 respectively.

Figure 8:
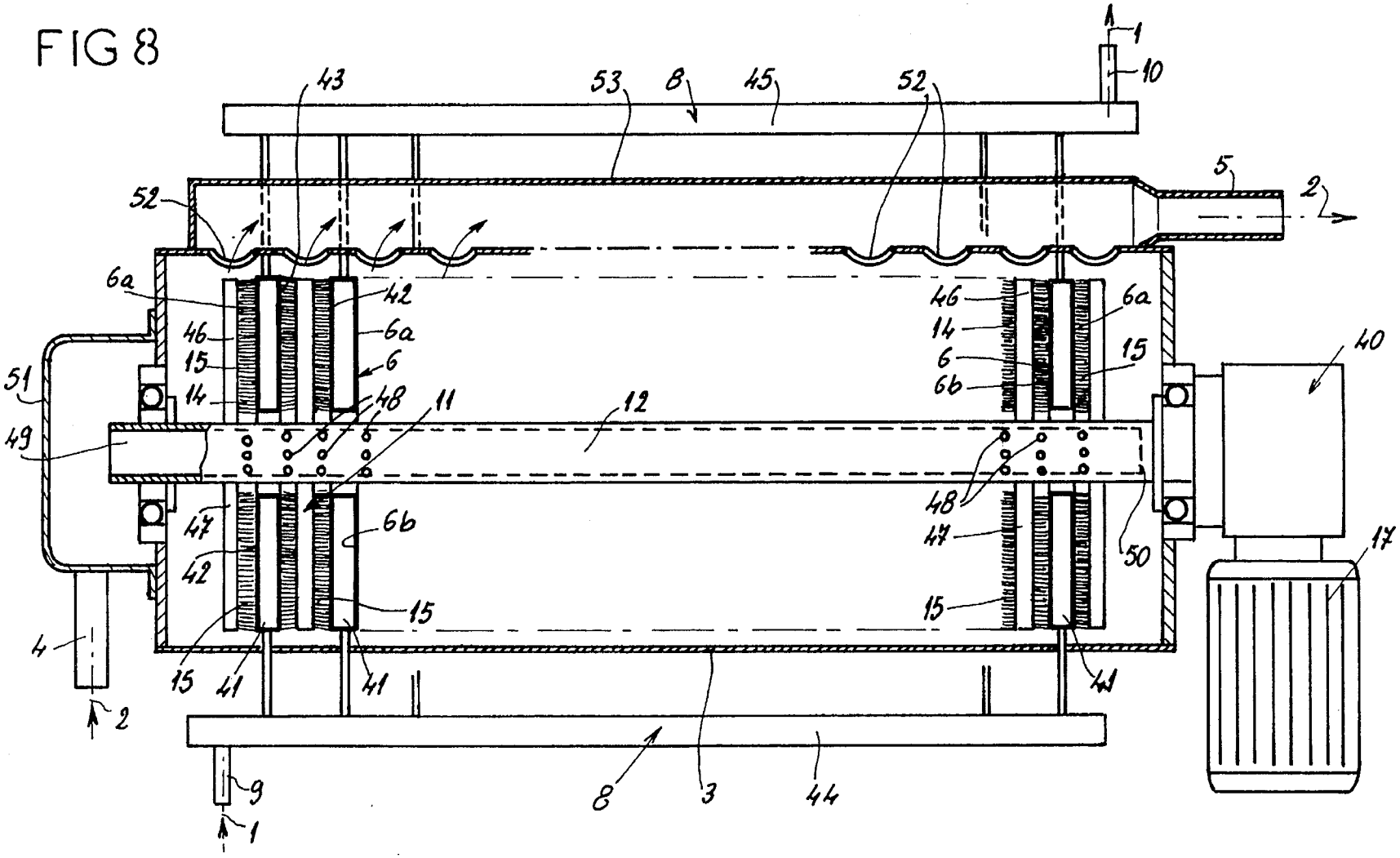
FIG. 8 depicts, in axial section, a heat exchange device according to a sixth embodiment of the invention.

The exchange device depicted in FIG. 8 differs from those described previously by the following technical characteristics:

1) A plurality of volumes 41 for passage of the refrigerant are arranged in parallel, coaxial with the axis of the rotor 12 and in a staged manner in the conduit 3 for circulation of the fluid to be cooled; each volume 41 comprises two radially extending partitions 42 and 43, each forming one element of the wall 6 for heat exchange between the fluid to be cooled and the refrigerant; in practice, and as depicted in FIG. 8, each volume 41 consists of a circular, hollow and flattened element, hollowed at its center, generally having the shape of a disk, and the two plane faces 42 and 43 of which constitute respectively the two aforementioned heat exchange partitions.

2) A distributor 44 for the refrigerant, in connection with the inlet 9 for said fluid, and a manifold 45 for the same fluid, in connection with the outlet 10 for the latter, are arranged outside the circulation conduit 3 and communicate with the plurality of the previously identified passage volumes 41.

3) A plurality of arms 46 and 47, each being radially extending, are fastened to the rotor 12 and are each arranged between two volumes 41 for passage of the refrigerant, or between one said volume and one end of the circulation conduit 3.

4) A plurality of filamentary members 15, such as defined previously, are mounted on the plurality of arms 46 and 47, each being radially oriented; as a consequence, the various flexible filaments 14 of the members 15 are individually directed along an axial direction, with their free ends adjacent to the warm face 6*a* of the previously identified various radial heat-exchange partitions 42 and 43.

As regards filamentary members 15, these are superimposed in pairs, possibly being angularly offset from one pair to another, as depicted more particularly in FIGS. 10 to 14.

As regards two filamentary members 15 belonging to the same pair, these are arranged in the same diametral plane. Furthermore, between two volumes 41, the same radially extending arm 46 or 47 bears two filamentary members 15, opposite each other, in connection with the two warm faces 6*a* of two heat exchange partitions 42 and 43, respectively forming part of the two aforementioned volumes 41, that is to say facing each other.

Still in FIG. 8, the fluid 2 to be cooled is introduced into the exchange device by virtue of the following arrangements:

the rotor 12 is hollow, with passages 48 towards the inside of the conduit 3, these being made through its wall and staged between the various volumes 41 for passage of the refrigerant, this being so in order to allow circulation of the fluid to be cooled, from an open end 49 to a closed end 50 of the rotor 12;

and a box 51 for introducing the fluid to be cooled is solely in connection with the open end 49 of the hollow rotor 12, and the inlet 4 for the fluid 2 to be cooled.

Moreover, the discharge of the cooled fluid is produced by the following arrangements:

a plurality of orifices 52 are made in the wall 3, being respectively staged in connection with the various interstices between the volumes 41 for passage of the refrigerant;

and a casing 53 for discharge of the cooled fluid is in connection, on the one hand, with all the orifices 52 of the conduit 3 and, on the other hand, with the outlet 5 of the cooled fluid.

Figure 9:
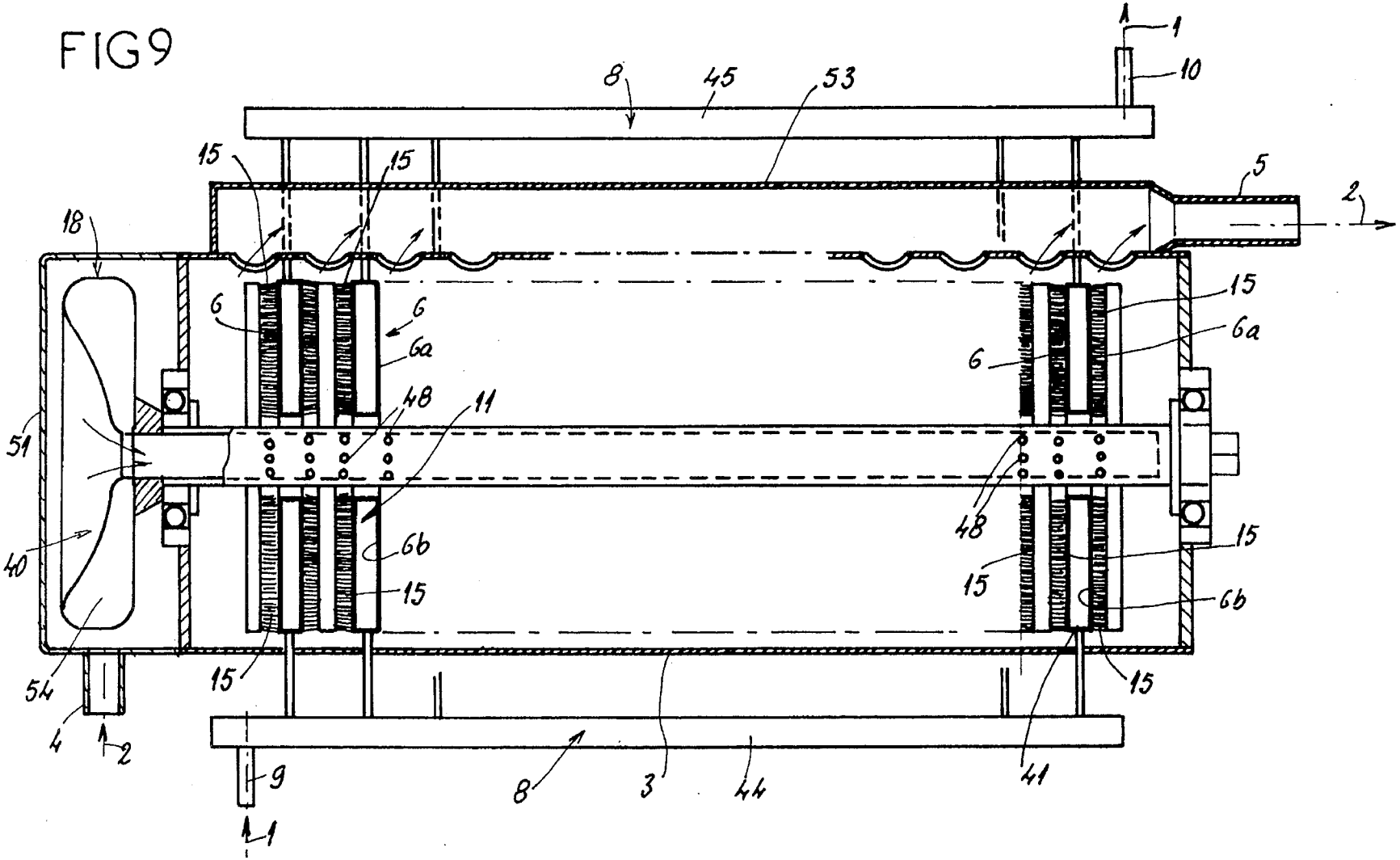
FIG. 9 depicts a heat exchange device according to a seventh embodiment of the invention, still in axial section.
Figure 10:
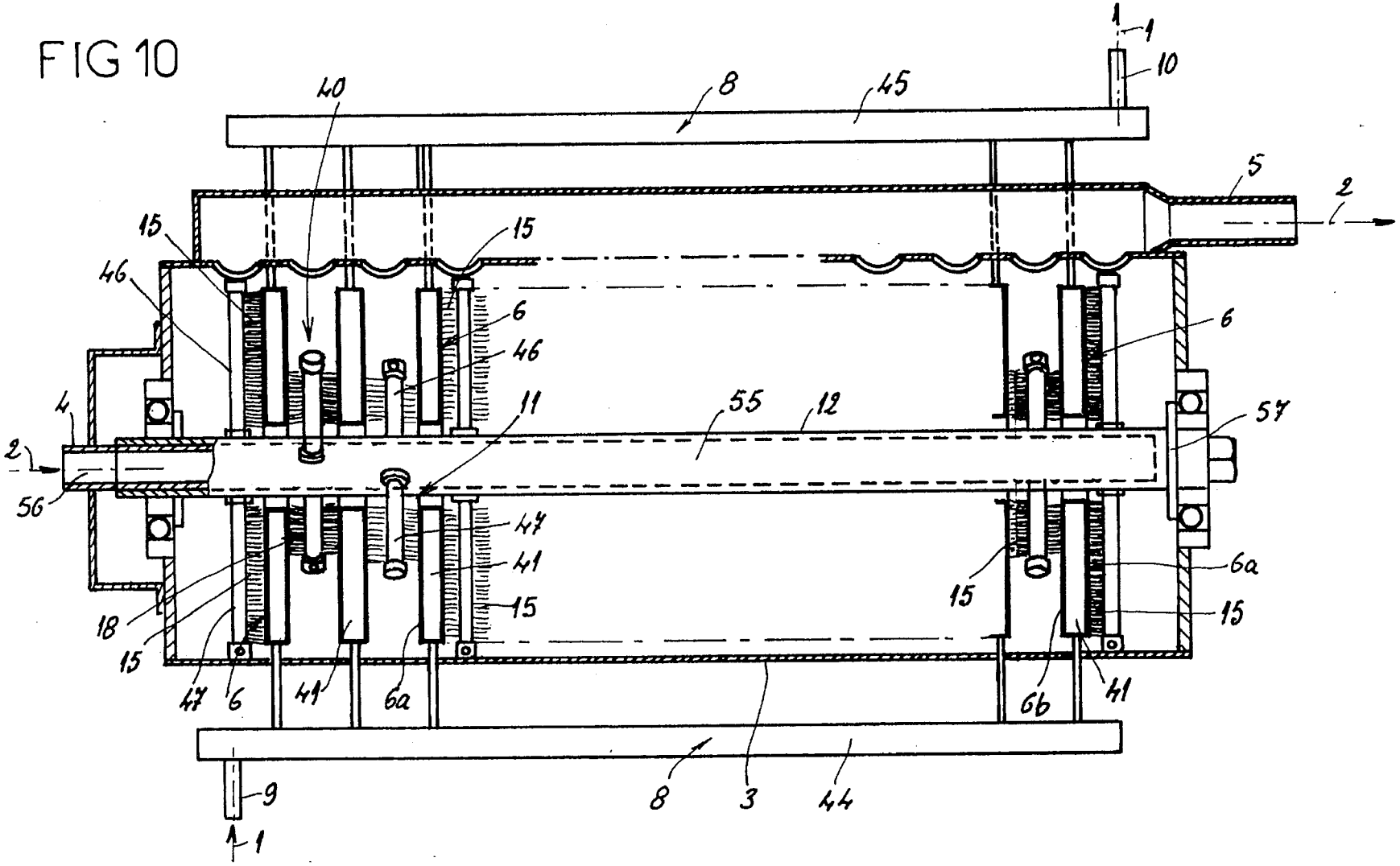
FIG. 10 depicts, in axial section, a device according to an eighth embodiment of the invention.
Figure 11:
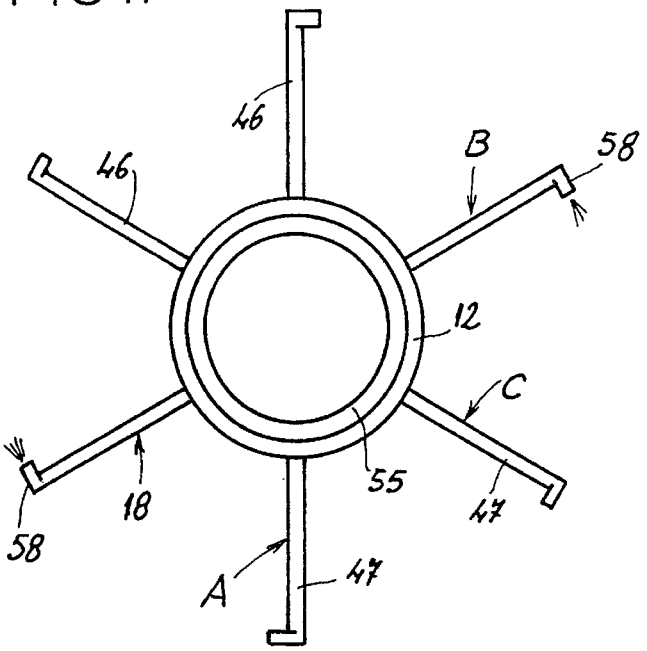
FIG. 11 depicts a view from above of the rotor forming part of the device according to FIG. 10.

The embodiment according to FIG. 9 essentially differs from the one described according to FIG. 8 by the presence of vanes 54 for driving the rotor 12, under the motory effect of the circulating fluid 2 to be cooled, these vanes being radially distributed in the box 51 for introducing said fluid.

To conclude, the final embodiment of the invention, according to FIGS. 10 to 14, differs from those described with reference to FIGS. 8 and 9 by the following various characteristics.

Firstly, automotory means for driving the rotor 12 are produced by the combination of the following arrangements:

the arrangement on the conduit 3 of a fixed tube 55, coaxial with the hollow rotor 12, including an open end 56 for the inlet 4 of the fluid to be cooled, passages 55*a* and 55*b* (cf FIGS. 12 to 14) for discharging the fluid to be cooled towards the rotor 12, and another, closed end 57; by construction, the rotor 12 is capable of rotating in a relatively sealed manner with respect to the fixed tube 55;

the various hollow radial arms 46 and 47 communicate with the inside of the rotor 12 and the aforementioned discharge passages 55*a* and 55*b* of the fixed tube 55 and include, at their free end, a means 58, such as a nozzle for ejecting the fluid to be cooled into the conduit 3. Next, the radial arms 46 and 47 are diametrally aligned in pairs, arranged in a staged manner along the axis of the conduit 3 (cf the pairs A, B, C depicted in FIGS. 11 to 14). For the two arms 46 and 47 of the same pair, for example A, the ejection means 58 are opposed, so as to allow rotation of the rotor 12, under the effect of the jets ejected by the means 58 of the same pair of arms.

Figure 12:
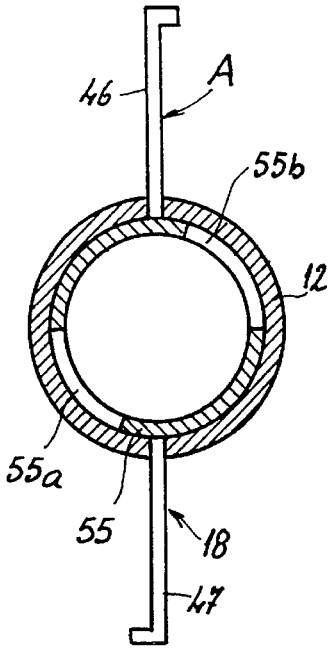
FIGS. 12 to 14 explain, in respectively superimposed transverse planes, the angular relationship existing between the fixed tube of the rotor of a device according to FIG. 10 and, respectively, three pairs of radial arms, these being superimposed but angularly offset with respect to each other.
Figure 13:
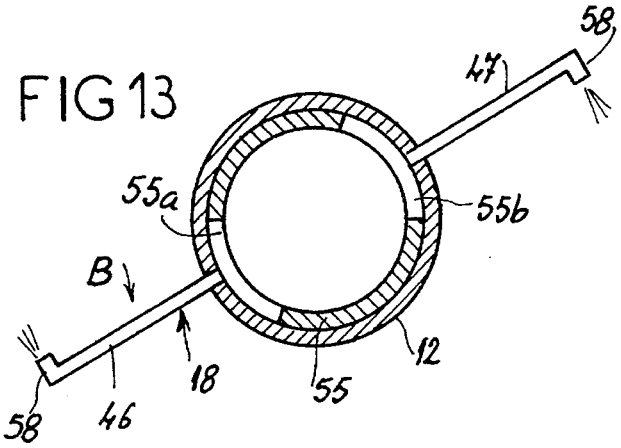
Figure 14:
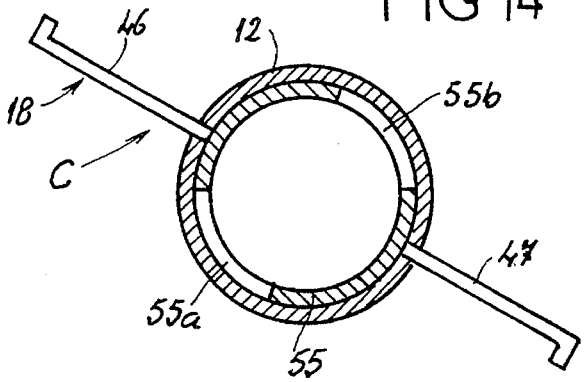

Finally, as depicted more clearly in FIGS. 12 to 14, the pairs of radial arms 46 and 47, for example A to C, are angularly offset with respect to each other, by a predetermined angle, for example 60°, according to the same direction of rotation, clockwise or anticlockwise. Correspondingly, the fixed tube 55 has two opposed axially elongate perforations 55*a* and 55*b*. The angular dimension of each perforation 55*a* or 55*b* is identical to the predetermined offset angle of one pair to another, for example 60°. Such an arrangement makes it possible not to eject the fluid to be cooled via all the radial arms 46 and 47 of the rotor 12, but successively in groups of pairs A, B and C respectively. In other words, the pairs A, B and C successively eject, in turn, the fluid to be cooled; and during the ejection of said fluid by, for example, a pair B, the pairs C and A are inactive.

I claim:

1. A method of conducting heat exchange between a refrigerant and a fluid to be cooled, comprising the steps of:

a) circulating at least one stream of the fluid to be cooled under pressure and causing the at least one stream of fluid to contact a first face of a heat exchange wall;

b) directing the refrigerant along a second face of the heat exchange wall; and c) mechanically resisting deposition on the first face of the heat exchange wall of any solid layer of the fluid to be cooled by creating a turbulent boundary layer in the at least one stream of fluid to be cooled.

2. The heat exchange method as claimed in claim 1, wherein the step of circulating includes circulating a plurality of streams of the fluid to be cooled.

3. The heat exchange method as claimed in claim 1, further comprising the step of vaporizing the refrigerant.

4. The heat exchange method as claimed in claim 1, further comprising the step of partially freezing the fluid to the exclusion of any congealing of the fluid.

5. The heat exchange method as claimed in claim 1, further comprising the step of undercooling the turbulent boundary layer in the liquid phase.

6. A device for conducting heat exchange between a refrigerant and a fluid to be cooled, comprising:

a) at least one conduit for circulating the fluid to be cooled under pressure, the at least one conduit having:

i) an inlet and an outlet for said fluid; and ii) a heat exchange wall including a first face and a second face, the first face being in contact with the fluid to be cooled and the second face being in contact with the refrigerant;

b) a passage device that passes the refrigerant along the second face; and c) a mechanical resist device including:

i) a rotor mounted within the conduit, ii) resisting elements, each of the elements being in the vicinity of the first face of the heat exchange wall and being distributed along the axis of and around the rotor, and iii) a rotor drive, wherein said resisting elements comprise a multiplicity of flexible filaments, each having a first end fastened to the rotor and a free second end adjacent to the first face of the heat exchange wall, whereby the elements agitate, in liquid phase, a boundary layer of the fluid to be cooled in contact with the first face of the heat exchange wall to resist deposition on the first face of the heat exchange wall of any solid layer of the fluid to be cooled.

7. The device as claimed in claim 6, wherein the passage device comprises a shell that forms a chamber around the at least one conduit for passage of the refrigerant, and the flexible filaments extend at least along a direction radial to the axis of the rotor.

8. The device as claimed in claim 7, wherein the filaments form a helix about the axis of the rotor.

9. The device as claimed in claim 7, further comprising:

a plurality of conduits arranged in parallel for circulating the fluid to be cooled;

a distributor for distributing the fluid to be cooled into the plurality of conduits; and a manifold for the cooled fluid discharged from the plurality of conduits, wherein the shell surrounds the plurality of conduits to form the chamber for passage of the refrigerant.

10. The device as claimed in claim 6, comprising a plurality of filamentary members, wherein each of the filamentary members includes a multiplicity of the flexible filaments.

11. The device according to claim 10, wherein the filamentary members are superimposed in groups of two along the length of the at least one conduit and each group is angularly offset with respect to the axis of the rotor from an adjacent one of the groups.

12. The device as claimed in claim 11, wherein the two filamentary members of each of the groups are arranged in the same diametral plane.

13. The device as claimed in claim 11, wherein at least one of the groups of filamentary members is angularly offset by one of 90° and 60° with respect to an adjacent one of the groups.

14. The device as claimed in claim 6, wherein the rotor drive includes the fluid to be cooled.

15. The device as claimed in claim 6, wherein said passage device comprises:

a plurality of parallel volumes for passage of the refrigerant, the plurality of volumes being coaxial with the axis of the rotor, each of the plurality of volumes having at least one radially extending partition forming the first face of the heat exchange wall;

a distributor forming an inlet for the refrigerant; and a manifold forming an outlet for said refrigerant, wherein the distributor and the manifold are arranged outside of the at least one conduit and communicate with the plurality of volumes for passage of the refrigerant, and the plurality of flexible filaments extend in a direction parallel to the axis of the rotor and have their free ends adjacent to at least one of the radially extending partitions.

16. The device as claimed in claim 15, wherein each of the plurality of volumes comprises a disk-shaped element hollowed at a center portion thereof, the disk-shaped element having two plane faces which respectively constitute the first and second faces.

17. The device as claimed in claim 15, further comprising an introduction device including:

a passage in the rotor leading to a plurality of outlets formed in a wall of the rotor, the plurality of outlets being staged between the volumes for the circulation of the fluid to be cooled, the passage forming an open end of said rotor; and a box for introducing the fluid to be cooled into the open end of the rotor.

18. The device as claimed in claim 6, wherein the refrigerant is vaporized.

19. The device as claimed in claim 6, wherein the fluid is partially frozen without any congealing thereof.

* * * * *